US007204393B2

(12) United States Patent
Strand

(10) Patent No.: US 7,204,393 B2
(45) Date of Patent: Apr. 17, 2007

(54) SPRAY ACTUATING MECHANISM FOR A DISPENSING CANISTER

(75) Inventor: Toralf H. Strand, Exeter, NH (US)

(73) Assignee: Summit Packaging, Inc., Manchester, NH (US)

( * ) Notice: Subject to any disclaimer, the term of this patent is extended or adjusted under 35 U.S.C. 154(b) by 0 days.

(21) Appl. No.: 11/202,538

(22) Filed: Aug. 12, 2005

(65) Prior Publication Data

US 2007/0034653 A1 Feb. 15, 2007

(51) Int. Cl.
*B65D 83/00* (2006.01)

(52) U.S. Cl. ..... 222/402.13; 222/402.21

(58) Field of Classification Search ..... 222/402.13, 222/402.15, 402.21
See application file for complete search history.

(56) References Cited

U.S. PATENT DOCUMENTS 3,185,350 A 5/1965 Abplanalp et al.
3,474,939 A 10/1969 O'Donnell et al.
3,583,607 A * 6/1971 Beck ..... 222/402.21
3,608,791 A 9/1971 Jordan et al.
3,721,423 A 3/1973 Shay
3,744,682 A 7/1973 Blank
3,754,689 A 8/1973 Blank
3,848,778 A 11/1974 Meshberg
3,884,393 A 5/1975 Wassilieff
3,937,368 A 2/1976 Hoagland
4,065,036 A 12/1977 Kirk, Jr.
4,068,782 A * 1/1978 Van der Heijden .... 222/402.13
4,071,173 A 1/1978 Horan
4,324,351 A 4/1982 Meshberg
4,418,842 A 12/1983 DiLoreto
4,542,837 A 9/1985 Rayner
4,572,410 A 2/1986 Brunet
4,773,567 A 9/1988 Stoody
5,027,982 A 7/1991 Demarest
5,158,206 A 10/1992 Kobayashi et al.
5,242,087 A 9/1993 Keldenich et al.
5,263,616 A * 11/1993 Abplanalp ..... 222/402.13
5,379,924 A 1/1995 Taylor
5,388,730 A 2/1995 Abbott et al.
5,597,095 A * 1/1997 Ferrara, Jr. ..... 222/402.12
5,624,055 A 4/1997 Clanet et al.
5,649,645 A 7/1997 Demarest et al.
6,062,432 A 5/2000 Estrada
6,126,044 A 10/2000 Smith
6,196,423 B1 3/2001 Erxleben
6,302,302 B1 10/2001 Albisetti
6,398,082 B2 6/2002 Clark et al.

(Continued)

*Primary Examiner*—Philippe Derakshani
(74) *Attorney, Agent, or Firm*—Davis Bujold & Daniels, P.L.L.C.

(57) ABSTRACT

A spray actuator for a pressurized aerosol canister that simplifies the mechanical moving parts of a spray actuator to a body and a trigger and a third nozzle piece being inserted at the very end of the product dispensing passage either in the body or the trigger. The moveable trigger rotates about a pivot or hinge point on the body and is biased by engagement with the valve stem or an additional spring return into a neutral unactuated position where the product is not dispensed. When dispensing of the product is desired, the user grasps the actuator and pulls the trigger against the body and overcomes the bias of the valve stem and the valve is actuated as discussed above to dispense the pressurized aerosol product.

21 Claims, 13 Drawing Sheets

U.S. PATENT DOCUMENTS

| | | | | |
|---|---|---|---|---|
| 6,523,722 | B1 | 2/2003 | Clark et al. | |
| 6,601,735 | B2 | 8/2003 | Milian et al. | |
| 6,691,896 | B2 | 2/2004 | Meshberg | |
| 6,695,171 | B2 | 2/2004 | Walters et al. | |
| 6,758,373 | B2 | 7/2004 | Jackson et al. | |
| D497,808 | S | 11/2004 | Morris et al. | |
| 6,817,488 | B2 | 11/2004 | Meshberg | |
| 6,832,700 | B2 | 12/2004 | Roberts et al. | |
| 6,932,244 | B2 | 8/2005 | Meshberg | |
| 2003/0168473 | A1 | 9/2003 | Ho | |
| 2004/0140324 | A1 | 7/2004 | Meshburg | |
| 2004/0140328 | A1* | 7/2004 | Pericard et al. | 222/402.13 |
| 2005/0017027 | A1 | 1/2005 | Yerby et al. | |

* cited by examiner 59
53
45
5
17
55
P
57
58

SPRAY ACTUATING MECHANISM FOR A DISPENSING CANISTER

FIELD OF THE INVENTION

This invention relates to an actuating mechanism for aerosol product dispensing containers, and more particularly to an aerosol spray valve actuating mechanism for actuating an aerosol spray valve and dispensing the aerosol product from the dispensing container.

BACKGROUND OF THE INVENTION

Aerosol dispensing containers generally comprise a pressurized canister within which is stored a product to be dispensed as an aerosol. The canister is pressurized, for example, by a propellant which is generally dissolved within the product. The product is released from the canister upon opening of for example a pressure actuated valve mechanism located in the top of the canister.

The valve mechanism generally comprises a valve stem defining a passage therethrough which communicates with the interior of the canister, and through which product may flow out of the canister when the valve is appropriately actuated. An orifice is often provided in the wall of the valve stem to provide access from the interior of the container to the passage. The valve stem is normally spring biased to a position in which the orifice is blocked or sealed so the product cannot enter the passage in the valve stem. A valve actuation assembly is generally mounted to the top of a canister to overly and engage with and actuate the valve stem. When the actuation assembly is appropriately triggered, the valve actuation assembly depresses, or tilts, the valve stem against the biasing force to unblock the orifice and allow the pressurized aerosol product within the canister to enter the passage in the valve stem.

Typically the actuator assembly includes a body or housing which is affixed to the top of the canister and an actuator plunger or button is fitted within the housing. The plunger or button generally fits over, or within the body in some manner, and connects with or at least indirectly engages or actuates the valve stem. A product passage is generally provided for guiding the released aerosol spray out of the spray can and through the valve actuation assembly to the environment. The product passage can be integral with either the body or the button, or even be a separate structure which communicates between the valve stem and a product dispensing orifice formed in the actuator.

When the button is depressed by a user, the valve stem is depressed or tilted and as the valve stem is depressed or tilted, the orifice within the valve stem is moved away from the seal, and the pressure within the dispensing canister pushes the aerosol product up through the orifice into the valve stem and hence into the passage and then into the product passage. Finally the product is dispensed via a nozzle out the dispensing orifice.

After dispensing the desired amount of product, the button is released. The spring bias within the valve mechanism provides the restoring or biasing force to return the valve stem to the closed position in which the orifice in the valve stem is sealed and aerosol product is no longer permitted to be dispensed. Currently known actuators of this type include many small parts which must be separately molded and then assembled. Obviously, the more parts which must be molded the more expensive the manufacture and assembly of such actuators becomes. Actuators are also known which attempt to reduce the number of separate parts which must be molded and assembled, however such actuators tend to be intricate, complicated moldings and are particularly difficult, and expensive to mold.

SUMMARY OF THE INVENTION

The present invention provides a spray actuator for a pressurized aerosol canister that overcomes certain shortcomings of prior art actuators and in particular trigger actuated spray actuators. Because of their functionality, trigger actuated spray actuators are composed of numerous parts which are firstly very difficult to mold, and secondly and perhaps more importantly, difficult to assemble. The present invention simplifies the mechanical moving parts of a spray actuator to a body and a trigger and finally a third nozzle piece being inserted at the very end of the product dispensing passage either in the body or the trigger. Thus, there are only three parts to the present invention including one moveable trigger portion.

The moveable trigger rotates about a pivot or hinge point on the body and is biased by engagement with the valve stem or an additional spring return into a neutral unactuated position where the product is not dispensed. When dispensing of the product is desired, the user grasps the actuator and pulls the trigger against the body and overcomes the bias of the valve stem and the valve is actuated as discussed above to dispense the pressurized aerosol product.

It is an object of the present invention to provide an economical and easy to manufacture and assemble spray actuator with a minimum number of parts and simple functionality.

It is a further object of the invention to provide a spray actuator which can be ergonomically actuated by one hand.

It is a still further object of the present invention to provide a spray actuator which requires minimal assembly and only three (3) separate molded parts.

The invention relates to a spray actuator for an aerosol container comprising a body having an engaging wall for attachment to an aerosol container, and a skirt circumferentially attached to the engaging wall and radially depending therefrom to provide a smooth transition with a sidewall of the aerosol container, a trigger hingedly attached to the body along a hinge axis and a nozzle supported in a product passageway formed in one of the trigger and the body, and wherein the hinge axis is disposed substantially vertically below the nozzle and the product passageway.

A method of making an actuator for dispensing an aerosol product from an aerosol container, the method comprising the steps of forming a one piece actuator body having a rim engaging wall, hinging a trigger to the actuator body along a hinge axis defined therebetween and inserting a nozzle in a product dispensing orifice integrally formed in one of the trigger and the actuator body, and positioning the hinge axis defined between the body and the trigger substantially vertically below the product passageway, the nozzle and the product dispensing orifice.

DETAILED DESCRIPTION OF THE PREFERRED EMBODIMENTS

Figure 1:
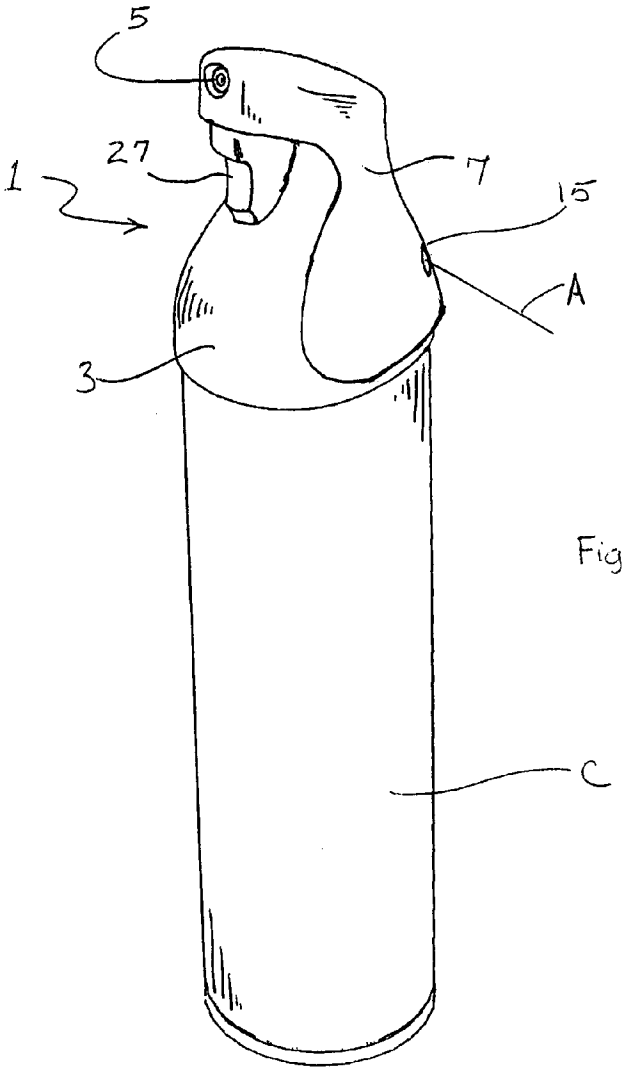
FIG. 1 is an elevational perspective view of a spray can having the spray actuator affixed to the top of the spray can.

As illustrated in FIG. 1, a spray aerosol dispensing container according to the present invention comprises a pressurized canister C and a spray actuator mechanism 1. The pressurized canister, or spray can C, contains a product to be dispensed as an aerosol, such as repellents, cleaners, fresheners i.e. any other fluid that may be dispensed as an aerosol. Typically a pressurized gas propellent, such as carbon dioxide, or other suitable gas is dissolved in the product, although any suitable manner of pressurizing the canister may be used.

The actuator 1 mechanism is composed of three main parts to facilitate the manufacture and assembly and lower the cost of producing the actuator 1. The three main parts are the body 3 of the actuator 1, a trigger 7 pivotally secured and supported on the body 3, and a nozzle 5 which may be inserted in a dispensing orifice 21 of the trigger 7 and communicates with a product passage way integrally formed in the actuator 1. Functionally, the trigger 7 is caused to rotate or move relative to the body 3 on an side of the actuator 1 opposite from the nozzle piece 5 in such a manner that a user can easily control the actuation of the valve with one hand and direct the ejected aerosol spray in a desired direction.

To achieve this functionality, a hinge axis A is defined between the body 3 and the trigger 7 in order to permit relative rotation between the two parts. The hinge axis A is further defined by a hinge 15 provided on a lower skirt 11 portion of the body 3 and which accordingly engages a lower cape 37 portion of the trigger 7. The hinge 15 and hinge axis A are typically provided on a side of the actuator 1 opposite from the dispensing orifice 21 and nozzle 5 of the actuator 1 so that the bias of the valve stem S acting on an upper portion of the trigger 7 pushes the upper portion of the trigger 7 away from the body 3 about the hinge axis A. Rotation of the trigger 7 about the hinge axis A thus defines two general positions, an unactuated position where the bias of the valve stem S maintains the trigger 7 in an essentially raised position, and an actuated position where a user squeezes the trigger 7 relative to the body 3 and the valve stem S and mechanism in the spray can C are actuated to dispense the aerosol product.

Figure 2:
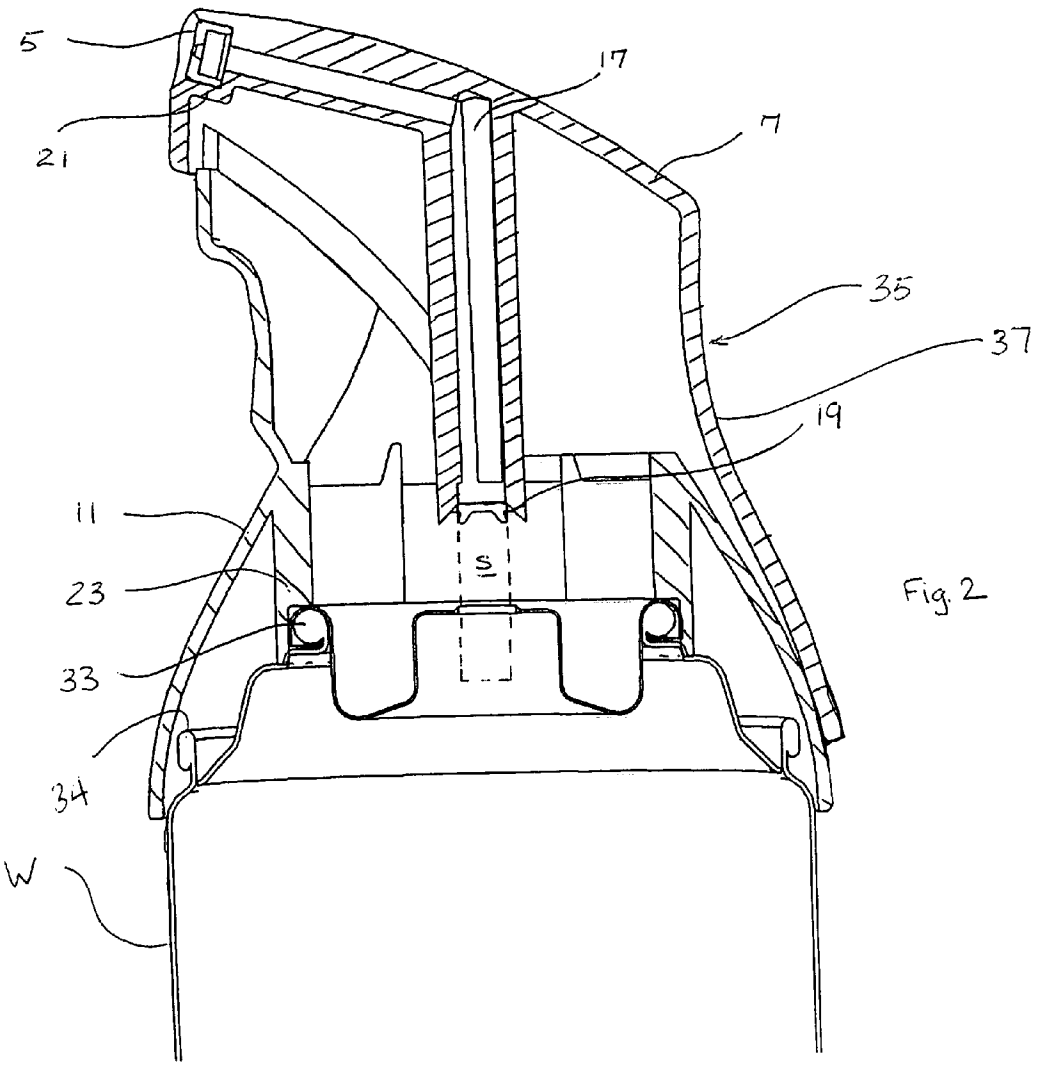
FIG. 2 is an elevational cross-section of the top of the spray can and supported spray actuator.

Turning to FIG. 2, the actuator 1 includes a product passageway 17 as an integral part of the trigger 7, the product passageway 17 having a valve stem S engaging portion 19 which communicates with the valve stem S and hence permits, when actuated, aerosol product to be dispensed from the can, through the valve stem S into the product passageway 17, and out of the actuator 1 via the dispensing orifice 21 and the nozzle 5 where it is ejected into the atmosphere.

The body 3 is provided with an engaging collar 23 which circumferentially engages via a snap-fit, with a mounting cup rim 33 of the spray can C. The engaging collar 23 extends upwards in a substantially vertical wall to a top portion which divides into a skirt 11 extending separate from and generally downward and outward away from the top edge of the can engaging collar 23. It is to be appreciated that the engaging collar 23 could be attached to either the mounting cup rim 33 or the outer can rim 34 to support the actuator 1 on the aerosol spray can C.

Figure 3A:
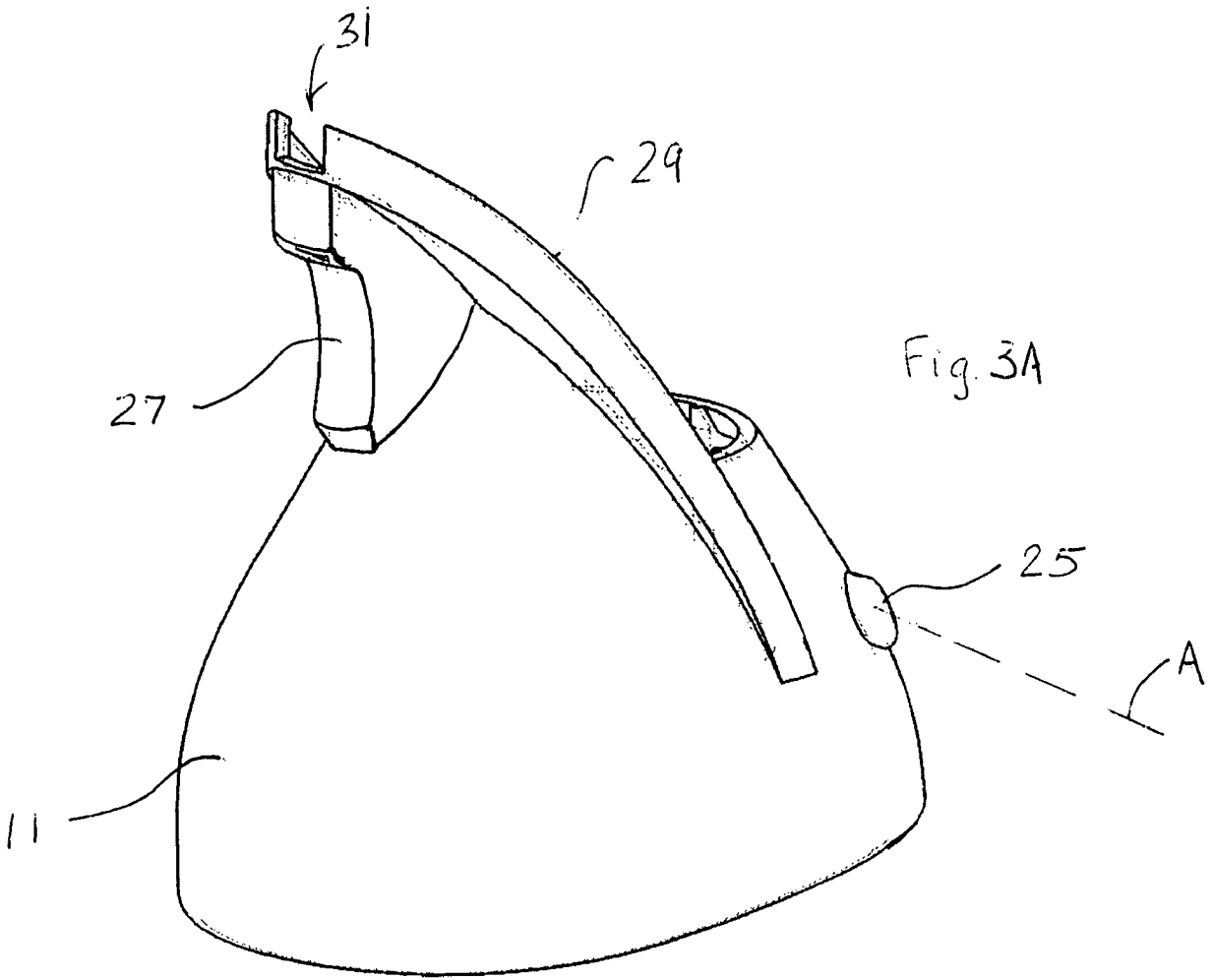
FIGS. 3A, 3B are perspective views of the front and rear respectively of the body of the spray actuator.
Figure 3B:
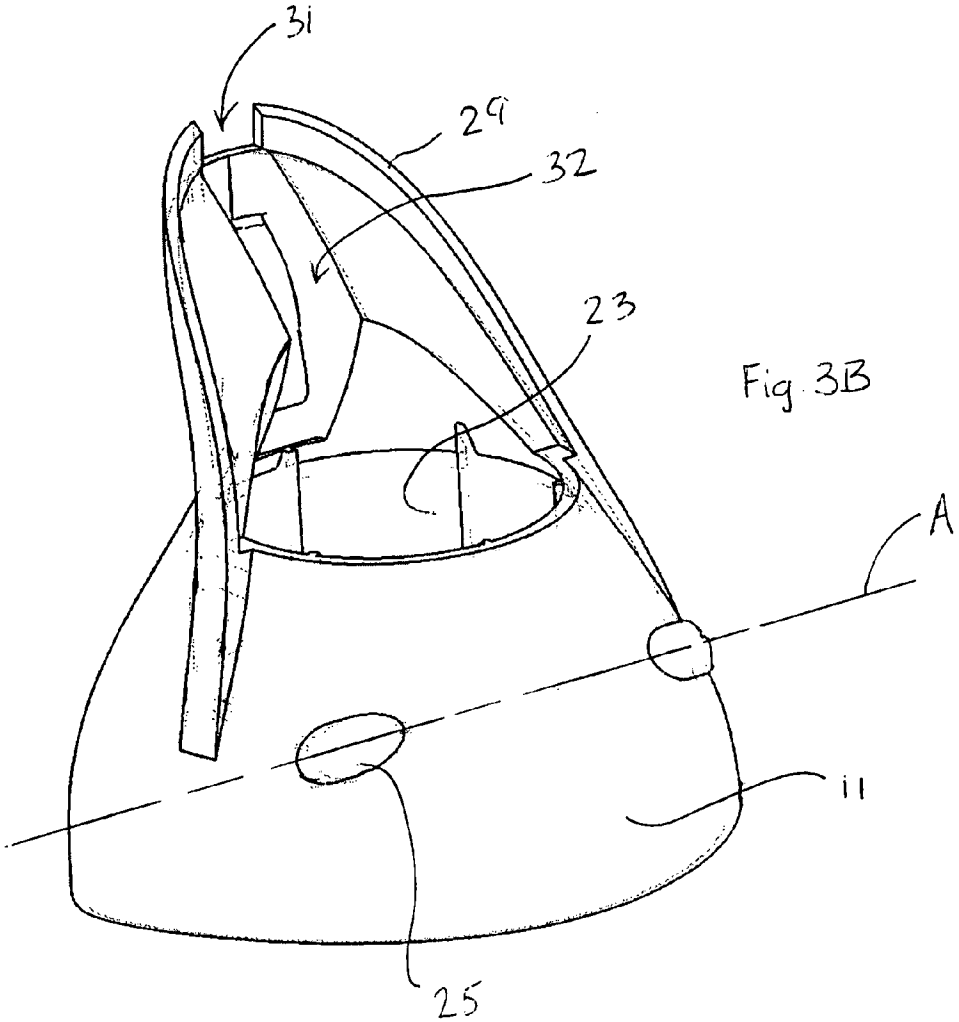

The skirt 11 depends downward circumferentially about the can, in order to provide an ergonomic cover over the top of the spray can C and provide a smooth and sleek transition between the outer can wall W and the spray actuator 1 itself. The skirt 11 is also provided as seen in FIGS. 3A–B, with separate hinge axis A defining engagement nubs 25 spaced horizontally apart on a lower portion of the skirt 11 and defining the hinge axis A therebetween. As will be discussed in further detail below these nubs 25 directly support the trigger 7 and engage corresponding holes or engagement points in the trigger 7 to form the hinge 15 and permit relative rotation between the trigger 7 and the body 3.

The body 3 also includes a static handle or finger support 27 portion extending substantially vertically upward from the skirt 11 and engaging collar 23 of the body 3. A finger support 27 includes an ergonomic finger support wall about which a user may wrap or place their fingers in order to provide sufficient grip and actuating force between the body 3 and the trigger 7 of the spray actuator 1. The finger support 27 is generally only formed around a portion of the circumference of the body 3 where a users fingers can readily engage the support 27 to provide a substantive grip and relative functionality to the trigger 7 mechanism. A top edge 29 of the finger support 27 may curve or depend downward from a top most portion of the finger support 27 to be integrally formed or molded into the skirt 11 or body 3 as best seen in FIG. 3A.

A cutout or notch 31 can be provided in the top most portion of the finger support 27 to facilitate actuation of the trigger 7 and permit an end most section of the product passageway 17 in the trigger 7, which defines the dispensing orifice 21, with a range of motion to pass below the top edge 29 of the finger support 27. As can be seen in FIG. 3B the notch 31 may be formed in conjunction with a hollow cavity 32 formed on the backside of the finger support 27. The cavity may be formed to maintain uniform wall thickness throughout the molding and provide sufficient room and clearance if necessary so as to permit the product passage 17 when tilted forwards to actuate the spray can C and provide room and range of motion for the product passage to be tilted in the direction of the finger support 27. It is to be appreciated that the body 3 and the engaging collar 23 and integral finger support 27 are essentially immovably connected or snap-fit to the upper rim 33 of the spray can C, i.e. the finger support 27 is essentially static relative to the can C and does not move but merely provides ergonomic grip for handling the actuator 1

Because a user's fingers generally engage the immovable finger support 27 to actuate the actuator 1, observing FIG. 2 and the moveable trigger 7 located opposite i.e. 180 degrees opposite the finger support 27, the trigger 7 defines a concavely formed palm support 35 on a cape 37 of the trigger 7 which depends downward on an opposite side of the trigger 7 from the dispensing orifice 21 formed in the trigger 7. As also seen in the views of the trigger 7 mechanism alone in FIGS. 4A and 4B, the cape 37 extends downward from the palm support 35 to a lower portion of the trigger 7 which includes engagement holes 41 for receiving the nubs 25 on the skirt 11. When the engagement holes 41 are secured with the nubs 25, the trigger 7 is thus rotatably attached to the lower portion of the skirt 11 of the body 3 along the hinge axis A defined thereby.

As discussed to some extent above, the hinge 15 is defined in the body 3 and the trigger 7 between a first and a second spaced apart nubs 25 on the body 3 which engage relative first and second spaced apart detents or engagement holes 41 provided in the trigger 7. The hinge axis A is substantially defined between the two nubs 25 and engagement holes 41 about which the trigger 7 is caused to rotate by squeezing pressure between the fingers and palm of a users hand between the trigger 7 and the body 3. It is to be appreciated that such engagement holes and nubs 25 may also be oppositely formed and located on the opposing corresponding articles and it further to be appreciated that other features and elements may be used to define a hinge axis A between the body 3 and trigger 7 of the actuator 1.

The trigger 7 includes the integral product passageway 17 to communicate between the valve stem S and the nozzle 5 in order to dispense the product as discussed in the summary of the invention. The product passageway 17 comprises an outlet passage 43 extending from the dispensing orifice 21 located in a nose of the trigger 7 to a communicating intersection with an inlet passage 45 depending downwards from a roof of the trigger 7 to engage the valve stem S. The inlet and outlet passages are joined at a substantially right angle or even a slightly obtuse angle to define the product passage 17 and facilitate the dispensing of the aerosol product.

Figure 4A:
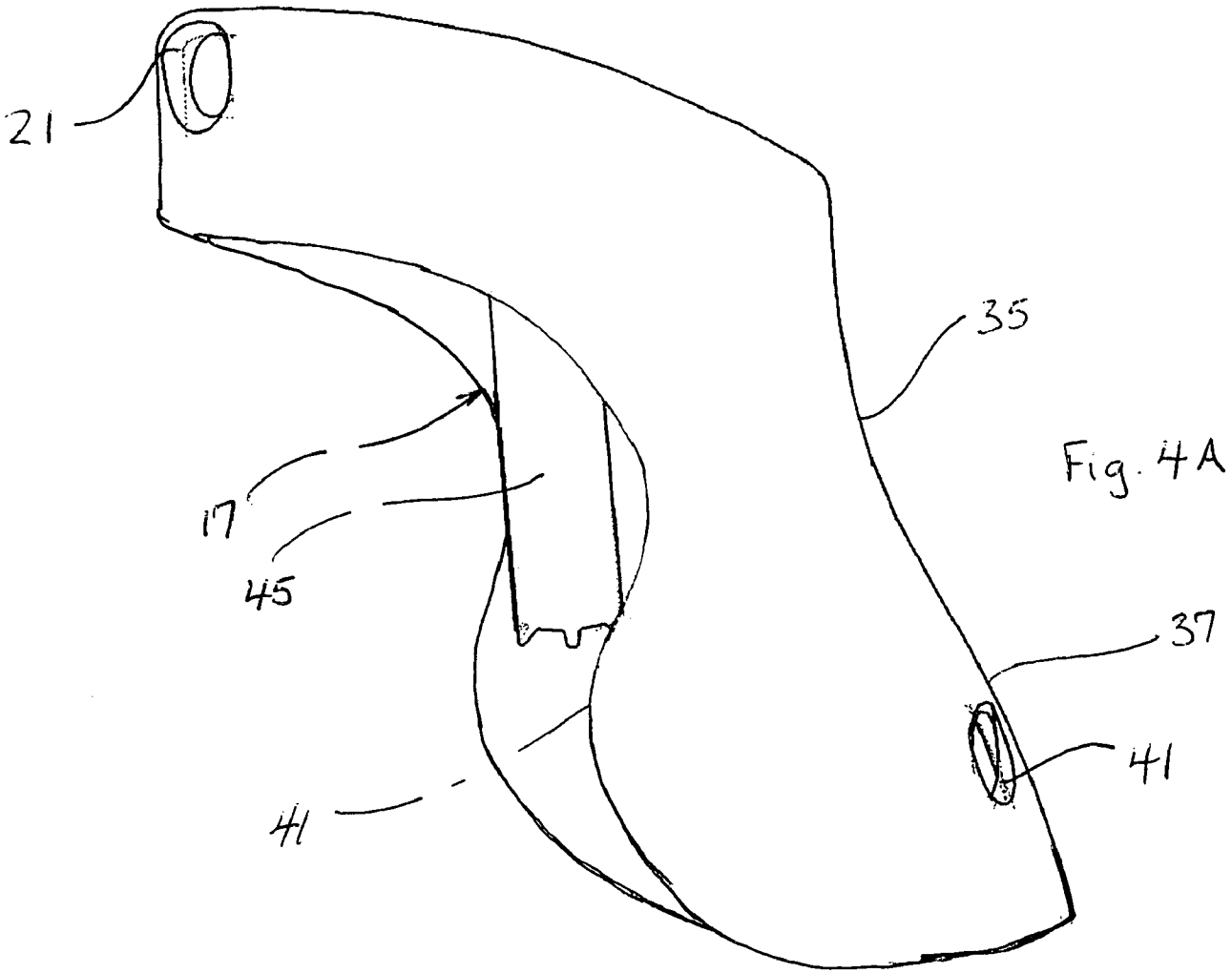
FIGS. 4A, 4B are perspective view and a cross section view respectively of the trigger of the spray actuator.
Figure 4B:
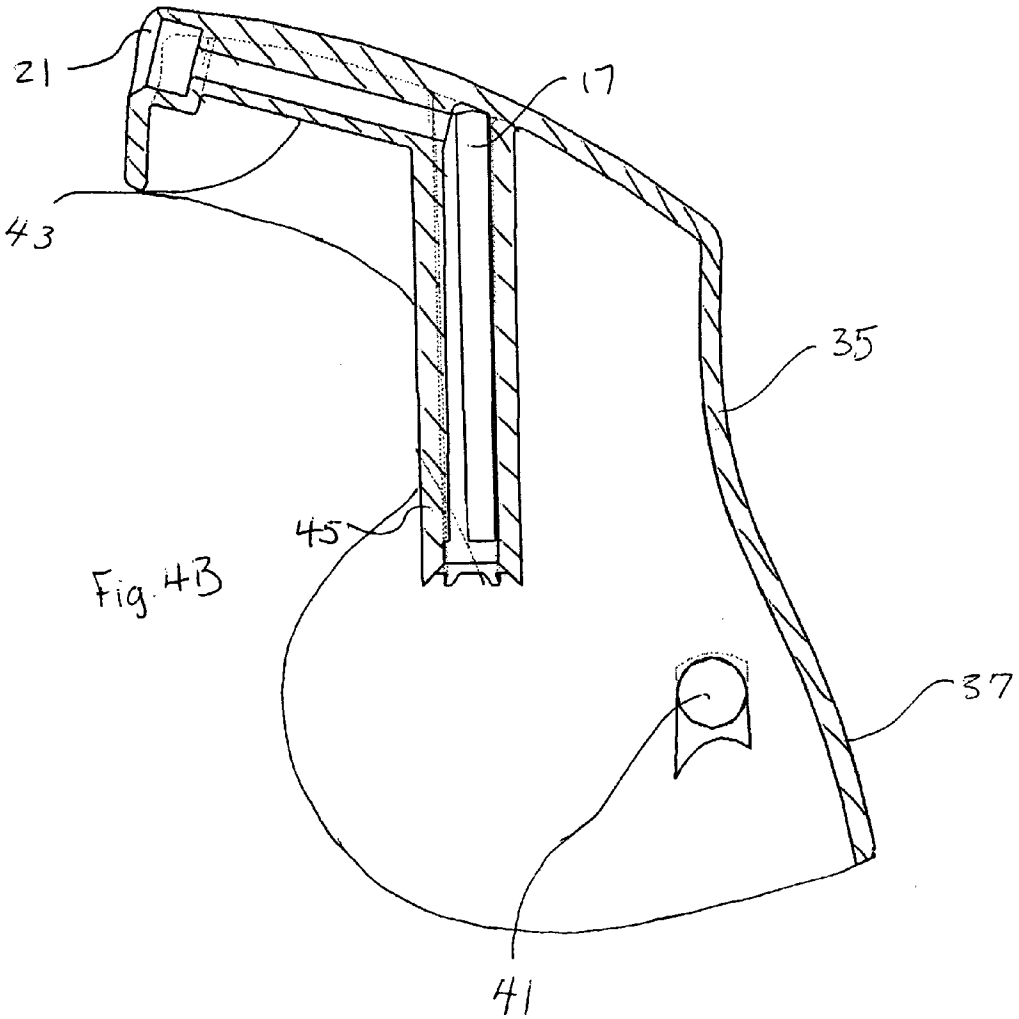

The dispensing orifice 21 which is formed at the free end of the outlet passage 43 includes an inner space as best seen in FIGS. 4A, 4B for receiving the nozzle 5. The nozzle 5 provides an appropriate spray formation and trajectory to the aerosol spray as it is dispensed from the container through the product passageway 17 and the dispensing orifice 21. The nozzle 5 which is the third article in this 3-piece mechanism may have a generally circular shape having an outer diameter substantially the same as an inner diameter of the dispensing orifice 21 in the nose of the trigger 7 so as to be press fit or otherwise fixed within the dispensing orifice 21. The nozzle 5 is provided with an outlet passage having a form such as an axial narrowing passage to cause acceleration of the pressurized product being dispensed and to define a particular desired outward spray of the aerosol product from the actuator 1. As the fabrication and design of aerosol nozzles is well known in the art no further discussion is therefore provided.

Observing FIGS. 4A, 4B which shows the trigger 7 mechanism by itself, the detents or engagement holes 41 formed in the trigger 7 are shown as being engaging portions for engaging the nubs 25 or pivots in the body 3. The detents or pivot holes 41 are defined in a trailing or tail portion of the cape 37 of the trigger 7 generally at a vertically lower position than the end of the product passageway 17 connection with the valve, but well above the lower most edge of the cape 37 portion of the trigger 7. This alignment thus defines a fulcrum point about the hinge axis A relative to the valve stem S so as to facilitate actuation of the valve stem S and provide for a biased and balanced rotation of the trigger 7 relative to the body 3.

The product passageway 17 comprises the substantially vertical inlet passage 45 which extends and depends substantially freely from the underside of the top most portion of the trigger 7 and which communicates with the substantially horizontally aligned outlet passage 43. The product passageway 17 is formed as shown here integrally with a roof, or inner top surface of the trigger 7 to facilitate the molding of the part. The dispensing orifice 21 is provided with a chamber in the dispensing orifice 21 large enough to accept the product nozzle 5.

Figure 5:
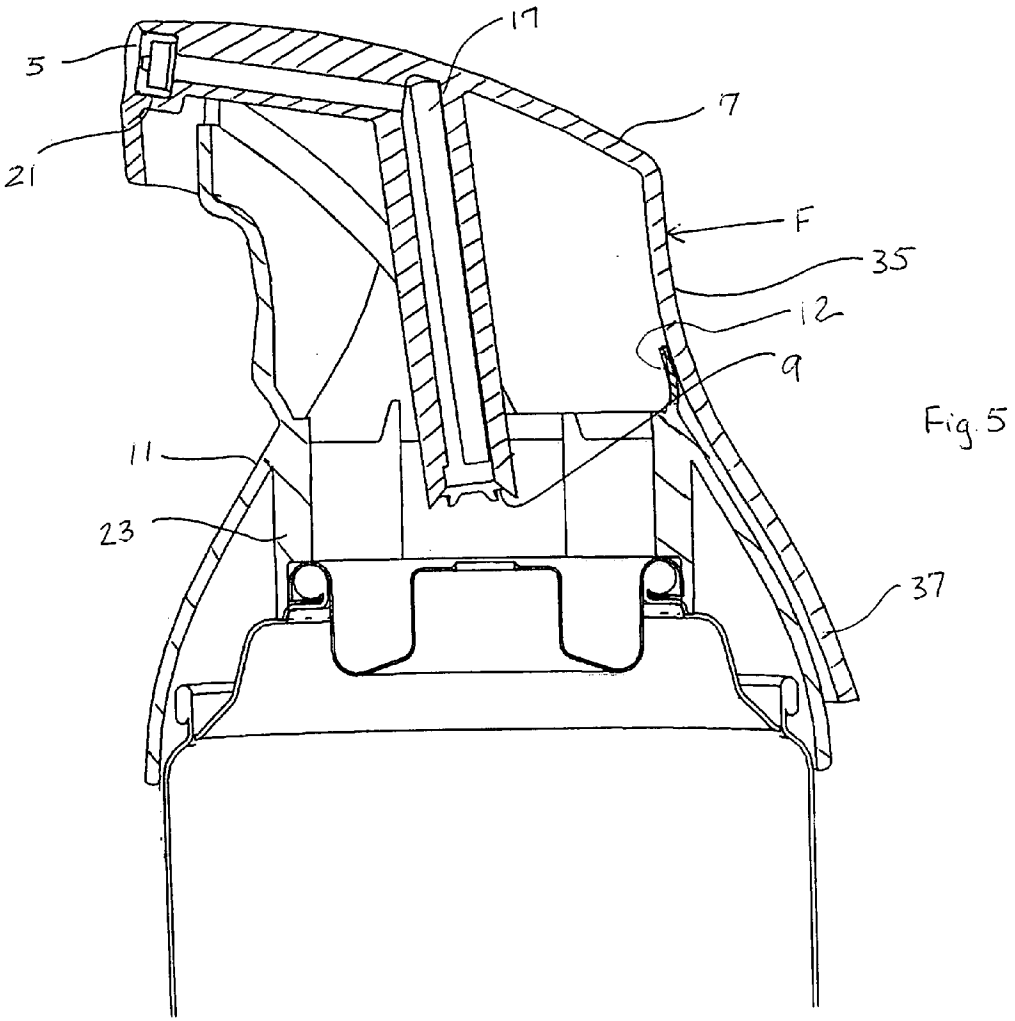
FIG. 5 is a cross sectional view of the actuator in an actuated position.

FIG. 2 shows the product passageway 17 in an unactuated position in which the inlet passage is substantially vertically aligned and communicating with the valve stem S. FIG. 5 shows the trigger 7 having been moved forward by a force F, usually applied by a user grasping the actuator 1 and squeezing their hand, relative to the body 3 and the relative tilt and downward movement of the product passage places a corresponding tilting or downward pressure on the valve stem S to actuate the valve in the spray can C. As known in the art, when the valve stem S is either pressed or tilted or both, the product is allowed to escape from the spray can C through the valve stem S and hence into the product passage and out through the nozzle 5 into the environment.

When the user desires to actuate the above described device, the user places the fingers of one hand around the body 3 and finger support 27, and places the palm of the hand against the palm support 35 of the trigger 7 above the hinge axis A. As the user squeezes the trigger 7 and body 3 with respect to one another the integral product passageway 17 is pushed substantially forward and down relative to the valve stem S. The outlet passage 43 of the product passageway 17 is permitted to pass downwards into the notch 31 in the body 3 and the inlet passage 45 presses on the valve stem S in such a manner that the aerosol product is released from the spray can C and into the valve stem S.

When the user desires to cease actuation, the user releases the squeezing pressure and the bias of the valve stem S presses up on the inlet passage 45 of the product passageway 17 and the trigger 7 is biased back into the unactuated position. It is also to be appreciated that a spring return mechanism as shown in FIG. 5 may also be provided to assist the return of the actuator back into the unactuated position. For example a leaf spring 12 may be integrally formed on either the trigger 7 or the body 3 and the leaf spring 12 may bear on and bias the trigger 7 and body 3 away from one another to an extent that when a user releases the squeezing pressure the trigger 7 is more quickly and efficiently returned to its unactuated position.

Figure 6:
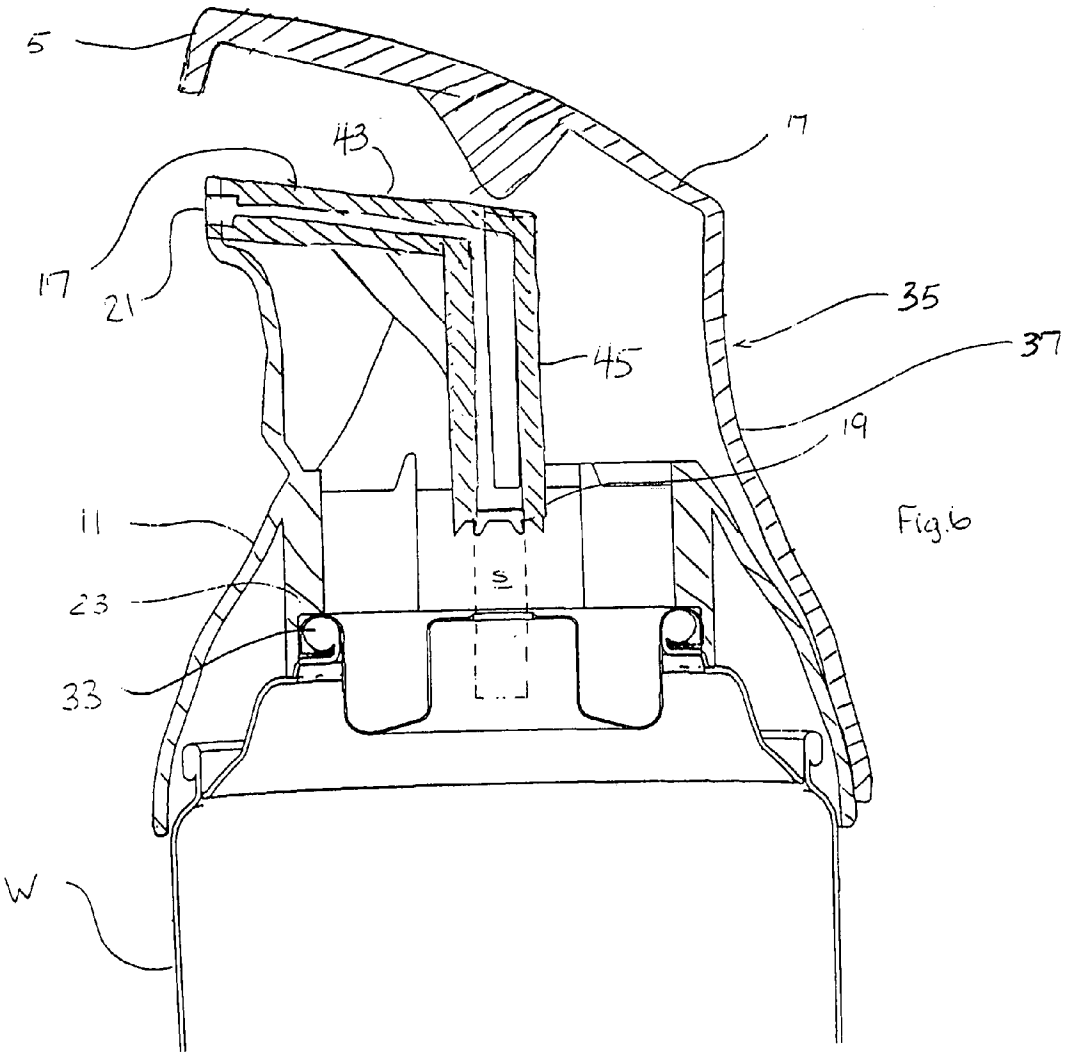
FIG. 6 is a further embodiment of the actuator with the nozzle integral with the base.
Figure 7:
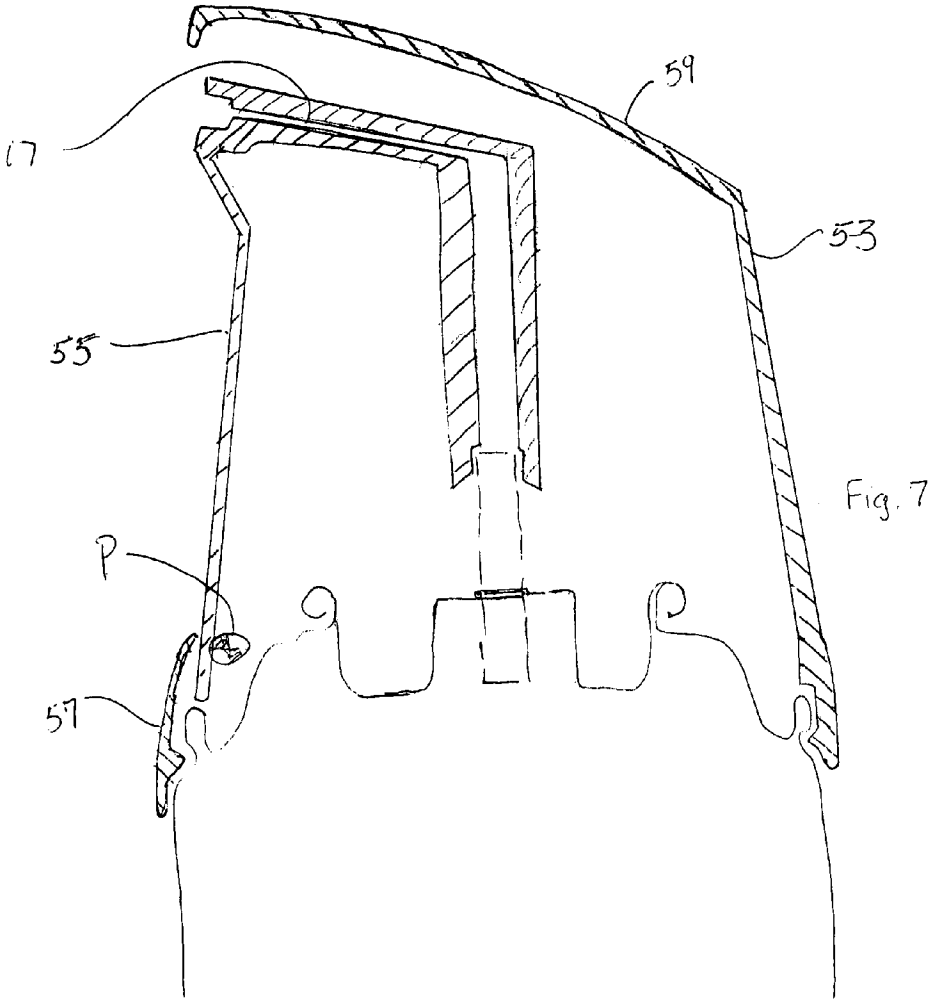
FIG. 7 is a still further embodiment of the actuator with a front mounted trigger.
Figure 8:
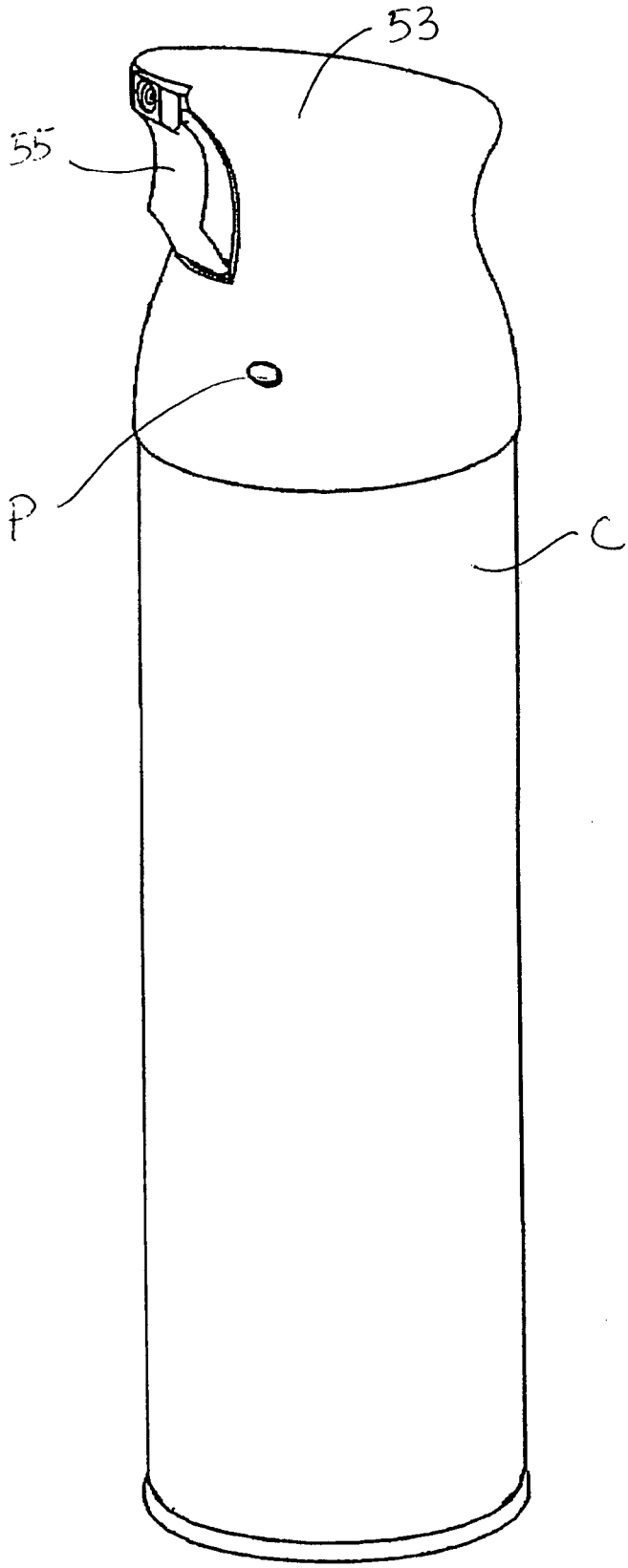
FIG. 8 is a perspective view of an exterior of the front mounted trigger embodiment.
Figure 9:
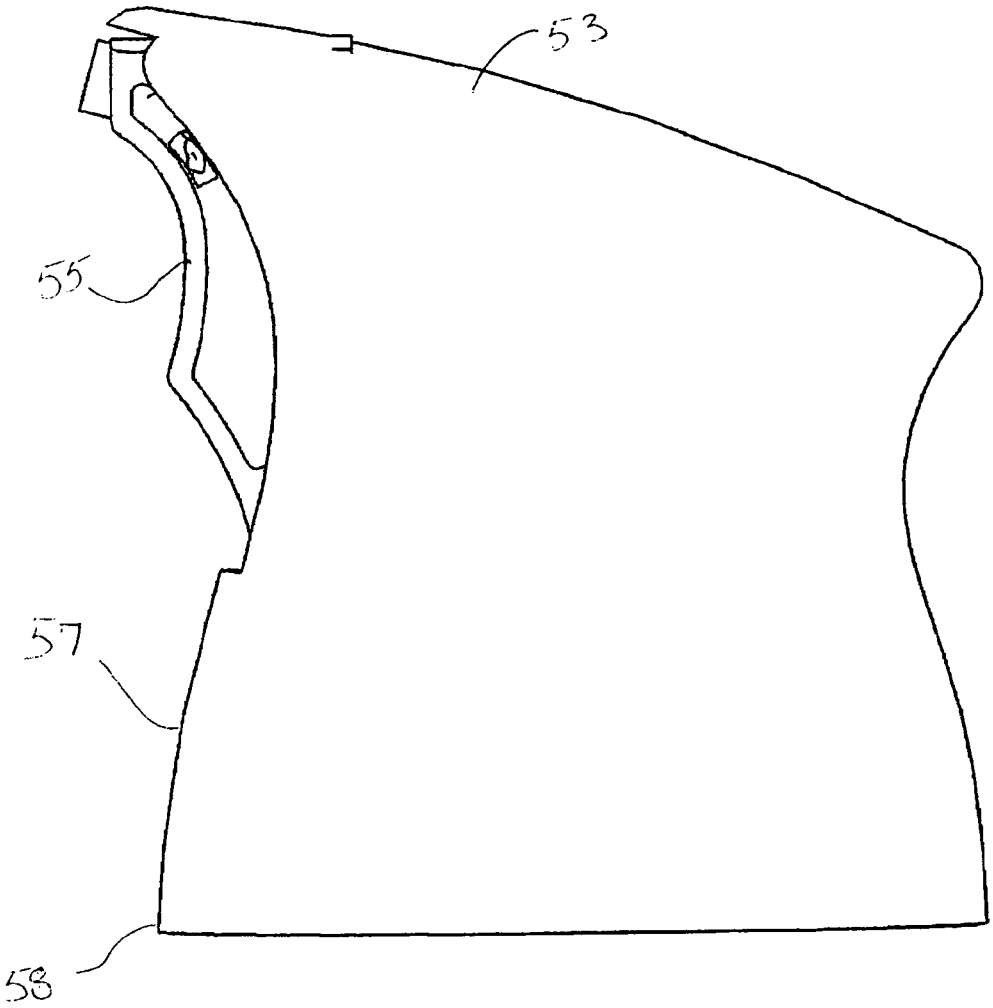
FIG. 9 is an elevational side view of the front mounted trigger embodiment.
Figure 10:
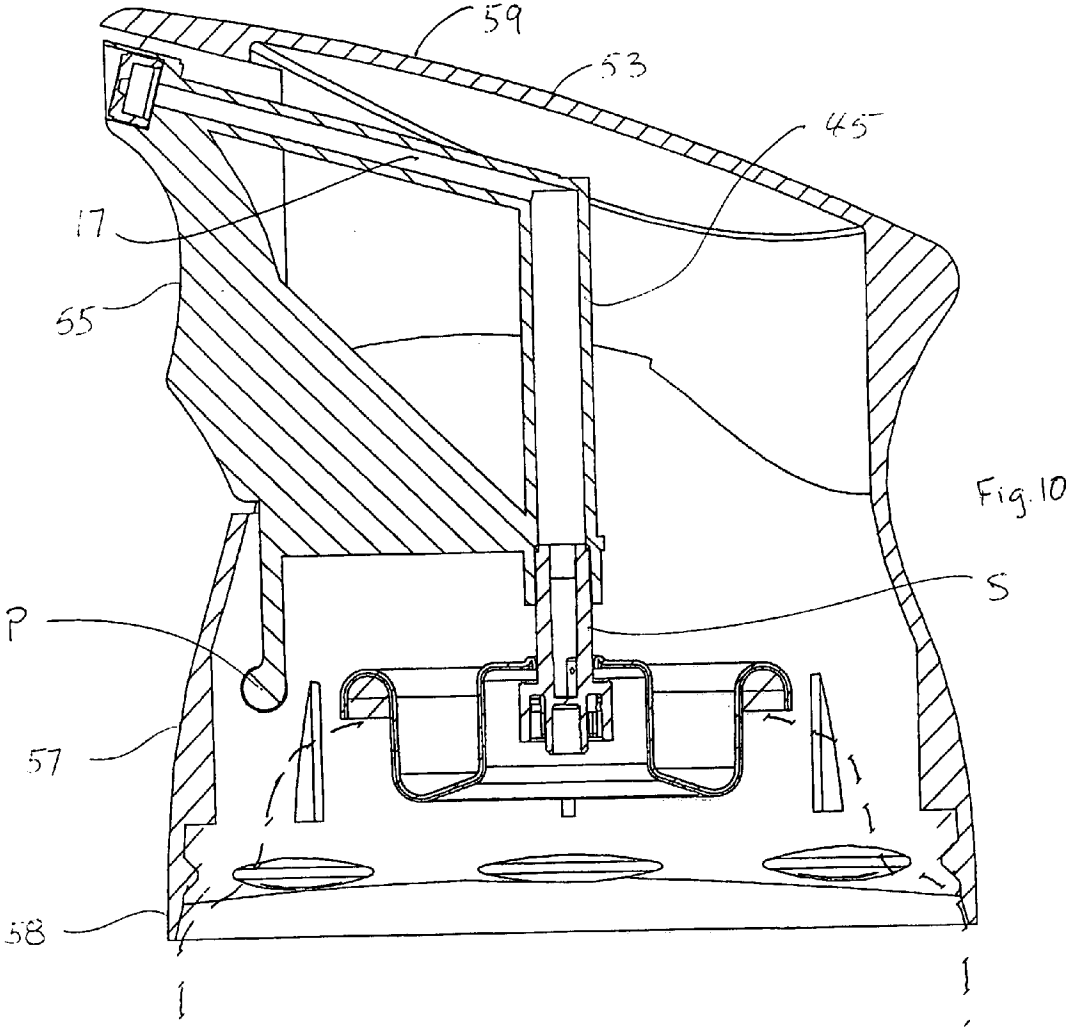
FIG. 10 is a cross sectional side view of the front mounted trigger embodiment.
Figure 11:
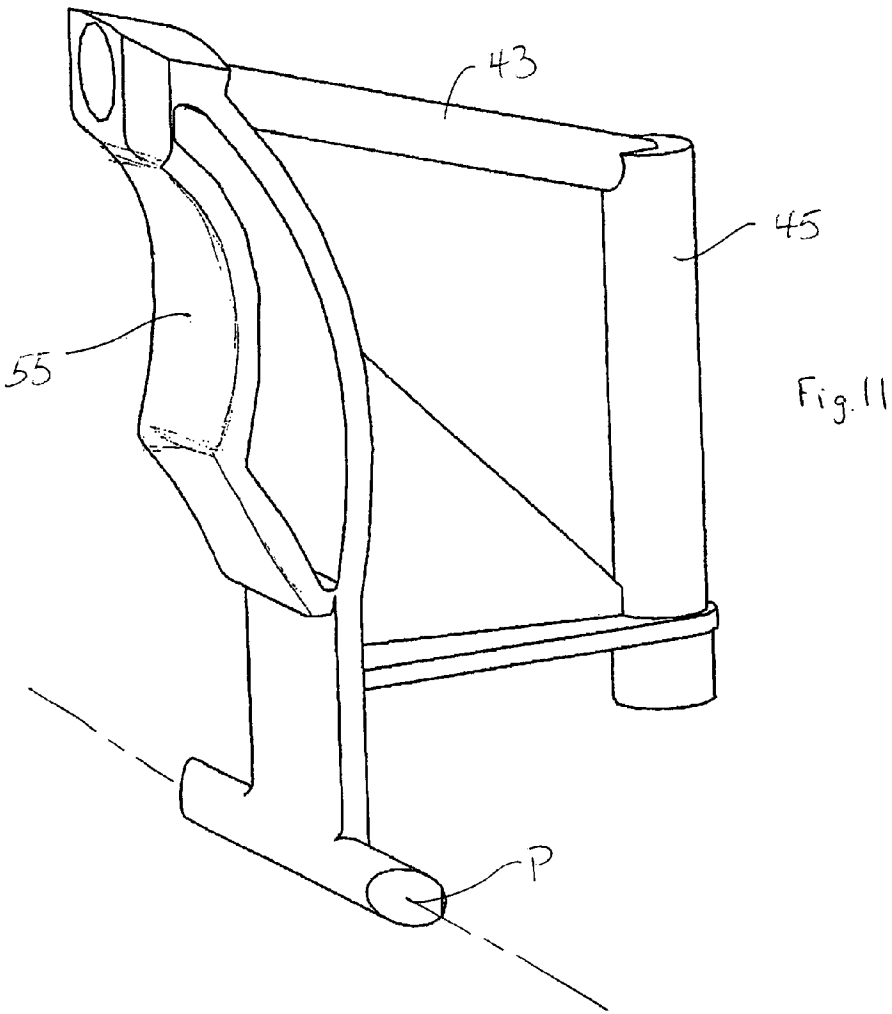
FIG. 11 is a perspective view of an integral trigger and product passageway for the front mounted trigger embodiment.

In FIG. 6 is shown a further embodiment having the inlet passage 45 and outlet passage 43 defining the product passage 17 integrally formed with the body 3. The outlet passage 43 is contiguous with the finger support 27, and the end most portion thereof defining the dispensing orifice 21 which supports the nozzle 5 is located directly above the portion of the finger support where a user's fingers usually grip the device. The trigger 7 rotating about an axis A as described in relation to the previous embodiment may be provided with a depending element for contacting the product passageway 17 and pushing or tilting the product passageway 17 to actuate the valve.

FIGS. 7–11 is a still further embodiment having a moveable trigger 55 on the front of the actuator having the product passageway 17 integrally formed therewith. The body 53 of the actuator being affixed to and extending circumferentially around one of the outer rim of the spray can and the mounting cup rim. The body 53 has a lower collar 57 including a skirt 58 depending therefrom, and an upper cover portion 59 which define an opening which permits a user access to the trigger 55 as well as an appropriate opening to allow the aerosol product to be dispensed. The trigger 55 is provided with a pivot point P, or an axis about which the trigger 55 rotates relative to the body 53 on the front side of the actuator. The user will generally pull rearward on the trigger 55 rotating the trigger 55 about the pivot P and forcing the inlet passage 45 to push downwards or tilt the valve stem S to actuate the spray can.

Since certain changes may be made in the above described invention, without departing from the spirit and scope of the invention herein involved, it is intended that all of the subject matter of the above description or shown in the accompanying drawings shall be interpreted merely as examples illustrating the inventive concept herein and shall not be construed as limiting the invention.

I claim:

1. A spray actuator for an aerosol container comprising:

a body having an engaging wall for attachment to an aerosol container, and a skirt circumferentially attached to the engaging wall and radially depending therefrom to provide a transition with a sidewall of the aerosol container;

a separate trigger hingedly attached to the body along a hinge axis and a dispensing orifice defined by a product passageway formed in one of the trigger and the body; and wherein the hinge axis is defined by the attachment of the separate trigger to the body and disposed substantially vertically below the dispensing orifice and the product passageway.

2. The spray actuator as set forth in claim 1 wherein the product passageway defines the dispensing orifice in an outlet end of the product passageway communicating directly with the outside environment and the product passageway is integrally formed with one of the trigger and the body to communicate contiguously with a valve stem in the aerosol container.

3. The spray actuator as set forth in claim 1 wherein the body further comprises a static finger support contiguous with and extending vertically above the engaging wall and the outer skirt.

4. The spray actuator as set forth in claim 3 wherein the finger support further comprises a top edge extending partially circumferentially around the body and having a notch in the finger support for facilitating the actuation of the trigger.

5. The spray actuator as set forth in claim 1 wherein the trigger comprises a contiguous top portion and downwardly depending cape portion which extends vertically below an inlet end of the product passageway.

6. The spray actuator as set forth in claim 1 wherein the hinge axis is defined by the attachment of the trigger and the body at a point lower than the product passageway such that when the trigger is squeezed the product passageway and the top portion of the trigger rotates about the hinge axis relative to the body of the spray actuator.

7. The spray actuator as set forth in claim 4 wherein the trigger further comprises a product passageway which is rotatably received within the notch in the top edge of the finger support when the trigger is actuated.

8. A spray actuator for an aerosol container consisting of 3 separate parts, a body, a trigger hingedly attached to the body and a nozzle inserted in a product dispensing orifice formed in one of the trigger and the body.

9. The spray actuator as set forth in claim 8 wherein the body comprises a base portion having a rim engaging collar and a skirt depending radially outward therefrom and a finger support extending vertically above the collar and the skirt.

10. The spray actuator as set forth in claim 9 wherein the trigger is hingedly supported on the base portion of the body and is rotatable relative to the body to actuate a valve in the container and release an aerosol contained therein.

11. A method of making a two-piece actuator for dispensing an aerosol product from an aerosol container, the method comprising the steps of:

forming a one piece actuator body having a rim engaging wall;

hinging a separately formed trigger to the actuator body along a hinge axis defined therebetween and inserting a nozzle in a product dispensing orifice integrally formed in one of the trigger and the actuator body; and positioning the hinge axis defined between the body and the trigger substantially vertically below the product passageway, the nozzle and the product dispensing orifice.

12. The method of making the actuator as set forth in claim 11 further comprising the step of integrally forming a skirt radially encompassing the rim engaging wall to provide a smooth transition with a sidewall of the aerosol container.

13. The method of making the actuator as set forth in claim 11 further comprising the step of constructing the actuator having only three (3) separately formed pieces being the actuator body, the trigger and the nozzle.

14. A two-piece spray actuator for an aerosol container comprising:

a circumferential base;

a separate trigger hingedly attached to the base along a hinge axis defined therebetween;

a product passage communicating contiguously between a valve in the aerosol container and a product dispensing orifice communicating directly with the outside environment, the product passage being formed in at least one of the trigger and base of the spray actuator; and wherein a nozzle is supported in the product dispensing orifice.

15. The spray actuator as set forth in claim 14 wherein the product passage is formed integral with one of the base and trigger.

16. The spray actuator as set forth in claim 14 wherein the hinge axis defined between the body and the trigger is located at a radial position substantially opposite from the product dispensing outlet.

17. The spray actuator as set forth in claim 14 wherein the hinge axis defined between the body and the trigger is located at a position substantially radially aligned with the product dispensing outlet.

18. The spray actuator as set forth in claim 14 wherein the trigger comprises a palm support substantially radially aligned with the hinge axis to facilitate the actuation of the trigger between a user's fingers and the user's palm of their hand moving the trigger about the hinge axis relative to the body of the spray actuator.

19. The spray actuator as set forth in claim 14 wherein the hinge axis is further defined by a rotatable connection between the skirt of the body and a cape portion of the trigger positioned substantially vertically lower on the spray actuator than the nozzle and the dispensing orifice.

20. The spray actuator as set forth in claim 14 wherein the hinge axis is defined between the body and the trigger on the same side of the actuator as the nozzle and the dispensing orifice.

21. The spray actuator as set forth in claim 14 wherein the base comprises a central collar which frictionally engages one of a mounting cup rim and an outer rim of the aerosol container to support the spray actuator on the container and a skirt substantially surrounding the central collar.

* * * * *